United States Patent [19]

Canevazzi

[11] Patent Number: 4,985,658

[45] Date of Patent: Jan. 15, 1991

[54] FRONT PANEL FOR COLOR TELEVISION TUBES

[75] Inventor: Giuliano Canevazzi, Grottaferrata, Italy

[73] Assignee: Videocolor, Courbevoie, France

[21] Appl. No.: 385,154

[22] Filed: Jul. 25, 1989

[30] Foreign Application Priority Data

Jul. 27, 1988 [FR] France ..... 88 10116

[51] Int. Cl.[5] ..... H01J 29/86

[52] U.S. Cl. ..... 313/477 R; 313/461; 220/2.1 A

[58] Field of Search ..... 313/477 R, 461; 220/2.1 A

[56] References Cited

U.S. PATENT DOCUMENTS

| | | | |
|---|---|---|---|
| 4,535,907 | 9/1985 | Tokita et al. | 220/2.1 A |
| 4,537,321 | 8/1985 | Tokita | 313/477 R X |
| 4,537,322 | 8/1985 | Okada et al. | 313/477 R X |
| 4,777,401 | 10/1988 | Hosokoshi et al. | 313/477 R |
| 4,786,840 | 11/1988 | Ragland | 313/477 R |
| 4,839,556 | 6/1989 | Ragland | 313/408 |
| 4,887,001 | 12/1989 | D'Amato et al. | 313/461 |

*Primary Examiner*—Sandra L. O'Shea

*Attorney, Agent, or Firm*—Joseph S. Tripoli; Dennis H. Irlbeck

[57] ABSTRACT

Disclosed are a method for the fabrication of a color television tube as well as a front panel for trichromatic television tubes. The disclosure can be applied to the reception of high-definition television transmissions. According to the disclosure, the front panels designed for a high-definition television tube screen are elements of the group of surfaces defined by $$Z=\Sigma(C(i)\cdot x^{j(i)}\cdot y^{k(i)}$$

$$Z(i)=Co(i)\cdot F^{-(j(i)+k(i)-1)}$$

$$100\cdot ABS(Zn-Z)<5\cdot Zd$$

where Z is the dimension of a surface of the group, Zn the dimension of a test surface and Zd the dimension of the maximum value of the dimension of the surface. Co corresponds to a reference surface of the group.

8 Claims, 1 Drawing Sheet

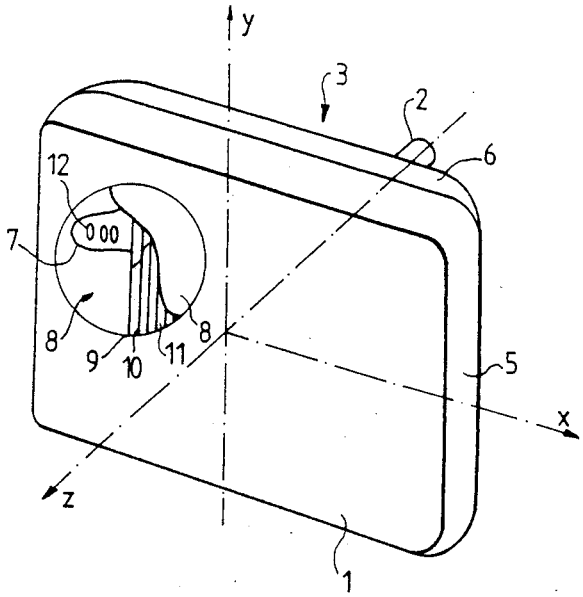
FIG. 1
FIG. 2
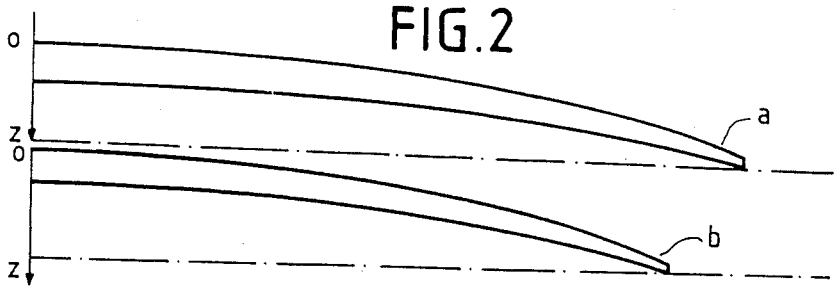
FIG. 3
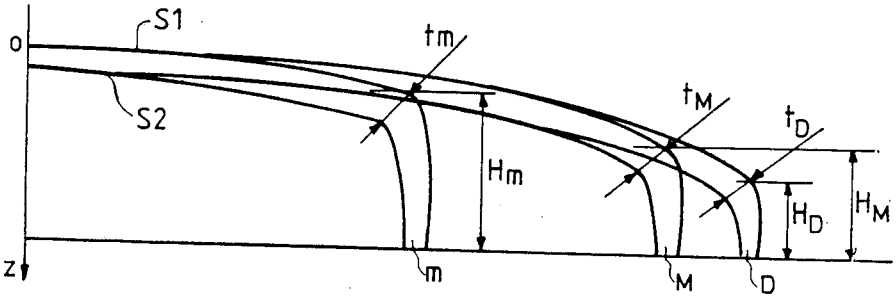

FRONT PANEL FOR COLOR TELEVISION TUBES

BACKGROUND OF THE INVENTION

1. Field of the Invention

The present invention concerns a method for the fabrication of a television color tube. It also concerns a front panel for trichromatic television tubes. It can be applied to the reception of high-definition television transmissions.

2. Description of the Prior Art

High-definition television is making it necessary to redefine the fabrication parameters for color television tubes. In particular, the European standard D2-MAC brings the user the following advantages:

plurality of languages in the program received;

stereophonic sound systems;

digital quality sound;

new services such as teletext;

ability to be adapted to HDTV (high-definition television) standards of television.

Advantages such as this require the following features in the tubes:

improvement in the size of the impact of the electron beams on the screen;

choice of substantially constant screen and mask pitches throughout the illuminated surface;

"cinemascope" format "wide" and "flat" screen with a ratio generally equal to 16/9;

good tolerance of the tube in terms of white and of color purity throughout the range of the intensities of electron beams;

good parameters of brilliance and contrast;

improvement of the anti-vibration characteristics of the mask (improved insensitivity to microphonic effects due, in particular, to shocks to the television set and to the vibrations produced by the loudspeakers of the television set).

In the prior art, the aesthetic quality of television tubes is gradually tending towards increasingly flat screens. One type of currently used "plane" front panel is called a "planar" front panel and is described in particular, in the U.S. Pat. Nos. 4,786,840 and 4,839,556. Tubes such as this work properly but require corrections to obtain good image geometry; these corrections cannot be obtained by the deflector alone.

Furthermore, the planeity of the screen has repercussions on the geometry of the mask and induces problems of thermomechanical behavior which take the form of doming and blister flaws.

A first object of the present invention is a method for the fabrication, for high-definition television, of a "wide" screen trichromatic tube (with a ratio of 16/9) but also capable of having the standard ratio 4/3, the screen of which is as flat as possible and requires the fewest possible geometrical corrections, a method that enables the making of a very wide range of tubes of very diverse dimensions and planeities, with the fabrication being done in the simplest possible way without using any cylindrical element in the illumination light box of the front panel.

Another object of the present invention is a trichromatic tube for high-definition television, in particular with a "wide" screen with a so-called "screen pitch" coefficient that is as constant as possible, the edges of the screen being as rectilinear as possible, the geometrical characteristics of the screen giving the linearity of the luminophor lines an optimal quality without the use of any cylindrical element in the illumination light box of the front panel, the performance characteristics of the tube being optimized with respect to the doming and blister coefficients, and of microphonic phenomena and with respect to the tolerance of purity of the colors.

The present invention proposes a method for the fabrication of a color television tube, comprising a glass envelope wherein there is included an electron gun in a neck and a shadow mask in front of an internal face of a screen front panel bearing luminophors, said method consisting in:

firstly, computing the internal area of the screen by a finite element method so that the screen pitch is substantially constant throughout the surface of the front panel;

then computing the mask matched with the front panel so that the mask pitch is substantially constant, if necessary in reiterating the computation of the internal surface area of the front panel;

computing the external surface area of the front panel by a finite element method so that the anti-implosion requirements relating to thickness and height of the skirt and the cost requirements of the front panel are achieved and, imprinting the layers of phosphors on the internal surface without resorting to cylindrical elements in the illumination light box.

SUMMARY OF THE INVENTION

The front panel according to the invention, for color television tubes, is suited to high-definition television (HDTV) of the type defined by a surface (S) with an equation:

$$Z=\Sigma(C(i)\cdot x^{j(i)}\cdot y^{k(i)})$$

where Z is the distance from any point of the surface to the plane tangential to this surface at its center, the sum relating on the whole number finite index i, x and y being the Cartesian coordinates of the points of this surface, and j and k being whole number coefficients respectively equal to 4, 2, 0, 4, 2, 0, 4, 2 for j, and equal to 4, 0, 2, 0, 2, 4, 2, 4 for k when i varies from 1 to 8. The coefficients C(i) have the equation $$C(i)=Co(i)\cdot F^{-(j(i)+k(i)-1)}$$

where the coefficients C(i) describe the group of front panels according to the invention for screen shapes determined by F, F being the ratio of the diagonals of one and the same group and being equal to 1 for a screen with a ratio 16/9 and a diagonal equal to 83 cm (33 inches) or a screen with a ration of 4/3 and a diagonal of 68 cm (27 inches), the coefficients Co(i) being given in the tables below for ratios of 16/9 and 4/3.

| | For 16/9: | | |
|---|---|---|---|
| 1 | Co(i) | j(i) | k(i) |
| 1 | −.23773301E-18 | 4 | 4 |
| 2 | .84293632E-04 | 4 | 0 |
| 3 | .43121367E-03 | 2 | 0 |
| 4 | .18365999E-08 | 4 | 0 |
| 5 | −.17170219E-08 | 2 | 2 |
| 6 | .79434857E-09 | 0 | 4 |
| 7 | .57689504E-14 | 4 | 2 |
| 8 | .24894724E-13 | 2 | 4 |

| | For 4/3: | | |
|---|---|---|---|
| i | Co(i) | j(i) | k(i) |
| 1 | −.58544384E-18 | 4 | 4 |
| 2 | .11218491E-03 | 2 | 0 |
| 3 | .35359521E-03 | 0 | 2 |
| 4 | .43294582E-08 | 4 | 0 |
| 5 | −.23872190E-08 | 2 | 2 |
| 6 | .65136582E-09 | 0 | 4 |
| 7 | .14001255E-13 | 4 | 2 |
| 8 | .35119581E-13 | 2 | 4 |

In practice, any surface (S1) is said to belong to the group (S) according to the invention if the difference Zn−Z of their respective equations, taken at the center of the screens, is:

$$100 \cdot ABS(Zn-Z) < 5 \cdot Zd$$

where Zd is the maximum value of Z on the large diagonal of the front panel.

Furthermore, the degree of planeity can be made to vary by the coefficients c(2) and c(4) in taking values proportionate to the values computed according to the equation giving Z(1). Thus, for a given value of F, it is possible to work on surfaces (S) with diverse planeities:

$$c(i) = k \cdot cO(i)$$

for i=2 and 4 only.

BRIEF DESCRIPTION OF THE DRAWINGS

Other features and advantages of the present invention will be better understood from the description of an embodiment, taken as a non-restrictive example and illustrated by the appended drawing, in which:

FIG. 1 is a drawing of a television tube in an exemplary embodiment of the invention;

FIG. 2 shows two sectional half-views of glass front panels according to the invention;

FIG. 3 shows sectional half-views of a glass front panel according to the invention, along three characteristic sectional planes.

The fabrication of color television tubes raises a great number of mutually interacting problems. Thus the glassware, namely that aspect of fabrication entailing the making of the glass front panels on which a display screen is to be made, brings into play principles of physics related to electromagnetic deflectors as well as principles of mechanics related to the presence of the mask, principles of physical chemistry related to the properties of receptivity of the electron beams and of conversion into visible radiation from the screen to the user.

FIG. 1 shows a television tube, according to the invention, with an 83 cm. diagonal and a ratio of 16/9. The axis Z is the central axis of the tube, corresponding substantially to the central electron beam with null deflection, namely when the gun 2 emits its three electron beams without any reception of the least deflection current by the deflector 3, installed around the neck of the tube.

The glass front panel 1, on which the display screen will be formed, is connected to a widened section 6 of the tube by a skirt 5 which is substantially parallel to the axis Z.

Inside the tube, there is a frame/shadow mask unit designed, chiefly, for making an efficient selection of the colors on the luminophors formed in parallel strips on the internal face of the front panel. The cutaway view of FIG. 1 shows a section of the glass front panel according to the invention, the layer 8 of phosphors designed to convert the electron beams coming from the gun 2 into visible radiation through the glass front panel 1 in the direction of the axis Z, and a shadow mask 7.

For a given value of deflection currents at the deflector, a hole 12 of the mask is selected. This oblong-shaped hole is crossed by the RED, GREEN and BLUE beams which excite the corresponding strip of electroluminescent phosphors 9, 10 or 11.

An advantage of the present invention lies in the fact that the geometrical imperatives of correspondence between each hole of the mask and the arrangement of the strips of phosphors are taken into account. For, since the radius of curvature of glass front panel is not constant at every point of its surface, the distribution of the strips 9, 10, 11 has to be taken into account to prevent the edge of a beam from striking a portion of a strip that does not correspond to it (which would result in a color purity defect).

FIG. 2 shows the half-sections of the external surfaces of the glass front panels according to the invention, made parallel to their big axis Ox(a) in the 83 cm (33-inch) 16/9 version for the curves (a) and in the 69 cm (27-inch) 4/3 version for the curves (b). In each set (a) and (b), the upper curve is made along the axis Ox passing through the center of the front panel and the lower curve is made on the horizontal edge of the screen, respectively.

The invention consists in taking into account each of the standard parameters related to the fabrication of a television tube and in then defining, by the finite element method, the equation of the internal surface S2 by the coordinate Z of any point of this surface:

$$Z = \Sigma(C(i) \cdot x^{j(i)} \cdot y^{k(i)})$$

an equation wherein j and k are whole number coefficients, the values of which are given in the above two tables which are established for Co(i) corresponding to an 83 cm. 16/9 screen and a 68 cm 4/3 screen respectively, with:

$$C(i) = Co(i) \cdot F^{-(j(i)+k(i)-1)},$$

an expression wherein F is the ratio of the diagonals of one and the same group and is equal to 1 for a screen with a ratio 16/9 and a diagonal equal to 83 cm. or for a screen with a ratio of 4/3 and a diagonal of 68 cm., the coefficients Co(i) being given by the above-mentioned tables. Thus, for a screen with a diagonal of 112 cm. (44 inches) F=4/3 and for a screen with a diagonal of 28 cm. (11 inches) F=⅓.

In a second stage, the mask, made of appropriate material, is computed in using standard materials such as steel and invar, in taking into account the performance characteristic of thermomechanical strength. Practically, the optimized compromise is achieved by iteration of the computations of the internal area S2 and of the geometry of the mask so as to obtain an appearance of planeity which is as good as possible.

In one exemplary embodiment, it was possible to obtain substantially constant screen pitches. They develop from 0.7 millimeters at the center of the screen to 0.8 millimeters at a corner.

Once the internal area S1 is determined, the mask being computed at the same time, the method of the invention enables the geometry of the external surface S2 to be computed.

This surface is subjected to the same imperatives of planeity, but should furthermore have good mechanical qualities and anti-implosion. To this end, the thickness t and the height H of the skirt are determined so as to have the optimum value. In one embodiment, shown in FIG. 3, these two parameters are controlled on the large dimension edge M, the small dimension edge m and the corner D. The corresponding values found are:

| | m | M | D |
|---|---|---|---|
| t | 20 | 18 | 18 |
| H | 102 | 79 | 73 |

where the dimensions are indicated in millimeters, for a 33" 16/9 front panel.

The planeity is adjusted by the coefficients c(i) assigned a multiplier factor p:

$$c'(i)=c(i)\cdot p:$$

In one exemplary embodiment, these factors are all equal to 1, except for the coefficients for i=2 and i=4, for which:

$$C'(2)=C(2)\cdot p \text{ and}$$

$$C'(4)=C(4)\cdot p$$

When p is greater than 1, the surface S2 is less plane, and when p is smaller than 1, the surface S2 is more plane.

As a rule, a surface Sn is said to belong to the group meeting the imperatives of the invention if its dimension Zn is such that:

$$100\cdot ABS(Zn-Z)<5\cdot Zd$$

where Z is the dimension of the homologous point of a reference surface belonging to the group of surfaces of the invention defined by the coefficients c(i) given in detail further above, and Zd is the value of the biggest dimension of this surface taken on the large diagonal.

What is claimed is:

1. A front panel for color television tubes, suited to high-definition television, each of the external and internal surfaces of which is of the type defined by a surface with an equation, $$Z=\Sigma(C(i)\cdot x^{j(i)}\cdot y^{k(i)})$$

where Z is the difference from any point of the surface to the plane tangential to the center of this surface, wherein the coefficients C(i) have the equation, $$C(i)=Co(i)\cdot F^{-(j(i)+k(i)-1)}$$

where the coefficients C(i) describe the group of front panels according to the invention for screen shapes determined by F, F being the ratio of the diagonals of one and the same group and being equal to 1 for a screen with a ratio 16/9 and a diagonal equal to 83 cm (33 inches) or a screen with a ratio of 4/3 and a diagonal of 68 cm (27 inches), the sum relating to the whole number finite index i, x and y being the Cartesian coordinates of the points of this surface, and j and k being whole number coefficients respectively equal to 4, 2, 0, 4, 2, 0, 4, 2 for j, and equal to 4, 0, 2, 0, 2, 4, 2, 4 for k when i varies from 1 to 8 the coefficients Co(i) being given in the tables below for ratios of 16/9 and 4/3,

[For] for 16/9[:]

| i | Co(i) | j(i) | k(i) |
|---|---|---|---|
| 1 | −.23773301E-18 | 4 | 4 |
| 2 | .84293632E-04 | 4 | 0 |
| 3 | .43121367E-03 | 2 | 0 |
| 4 | .18365999E-08 | 4 | 0 |
| 5 | −.17170219E-08 | 2 | 2 |
| 6 | .79434857E-09 | 0 | 4 |
| 7 | .57689504E-14 | 4 | 2 |
| 8 | .24894724E-13 | 2 | 4 |

[For] for 4/3[:]

| i | Co(i) | j(i) | k(i) |
|---|---|---|---|
| 1 | −.58544384E-18 | 4 | 4 |
| 2 | .11218491E-03 | 2 | 0 |
| 3 | .35359521E-03 | 0 | 2 |
| 4 | .43294582E-08 | 4 | 0 |
| 5 | −.23872190E-08 | 2 | 2 |
| 6 | .65136582E-09 | 0 | 4 |
| 7 | .14001255E-13 | 4 | 2 |
| 8 | .35119581E-13 | 2 | 4 |

where x and y are in millimeters.

2. A front panel according to claim 1, wherein the planeity of the screen is determined by the change in the coefficients c(i) in p·c(i).

3. A front panel according to claim 2, wherein the only variable coefficients are c(2) and c(4).

4. A front panel wherein, if Zn is the distance from a point of its internal or external surface to a plane tangential to the center of this surface, and if Z is the distance from a homologous point of a second surface, according to claim 1, to a plane tangential to this second surface at its center, we have, $$100\cdot ABS(Zn-Z)<5\cdot Zd$$

Zd being the maximum value of Z on the large diagonal of the front panel.

5. A front panel for color television tubes, each of the external and internal surfaces of which is of the type defined by a surface with an approximate equation, $$Z=\Sigma C(i)\cdot x^{j(i)}\cdot y^{k(i)}$$

where,

Z is the distance from a plane tangent to the center of the surface contour to points on said surface, x and y represent distances from the center of said panel in Cartesian coordinates, C(i) are a series of coefficients that weight the various $x^{j(i)}\cdot y^{k(i)}$ terms, the coefficients C(i) being convertible into coefficients for other screen diagonal sizes by the equation, $$C(i)=Co(i)\cdot F^{-[j(i)+k(i)-1]},$$

where,

Co(i) are the coefficients in the table below,

F is a scale factor, equal to the diagonal of the screen of a tube, in centimeters, divided by 83 centimeters, j(i) and k(i) are coefficient powers to which the values of x and y, respectively, are raised to in said equation, and where the approximate values for the coefficients Co(i) and coefficient powers j(i) and k(i) are presented as follows for a panel having a screen with a 16 by 9 aspect ratio,

| i | Co(i) | j(i) | k(i) |
|---|---|---|---|
| 1 | −.23773301E-18 | 4 | 4 |
| 2 | .84293632E-04 | 4 | 0 |
| 3 | .43121367E-03 | 2 | 0 |
| 4 | .18365999E-08 | 4 | 0 |
| 5 | −.17170219E-08 | 2 | 2 |
| 6 | .79434857E-09 | 0 | 4 |
| 7 | .57689504E-14 | 4 | 2 |
| 8 | .24894724E-13 | 2 | 4 |

where x and y are in millimeters.

6. A front panel for color television tubes, each of the external and internal surfaces of which is of the type defined by a surface with an approximate equation, $$Z=\Sigma C(i)\cdot x^{j(i)}\cdot y^{k(i)}$$

where,

Z is the distance from a plane tangent to the center of the surface contour to points on said surface, x and y represent distances from the center of said panel in Cartesian coordinates, C(i) are a series of coefficients that weight the various $x^{j(i)}\cdot y^{k(i)}$ terms, the coefficients C(i) being convertible into coefficients for other screen diagonal sizes by the equation, $$C(i)=Co(i)\cdot F^{-[j(i)+k(i)-1]},$$

where,

Co(i) are the coefficients in the table below,

F is a scale factor, equal to the diagonal of the screen of a tube, in centimeters, divided by 68 centimeters, j(i) and k(i) are coefficient powers to which the values of x and y, respectively, are raised to in said equation, and where the approximate values for the coefficients Co(i) and coefficient powers j(i) and k(i) are presented as follows for a panel having a screen with a 4 by 3 aspect ratio,

| i | Co(i) | 4 | k(i) |
|---|---|---|---|
| 1 | −.58544384E-18 | 4 | 4 |
| 2 | .11218491E-03 | 4 | 0 |
| 3 | .35359521E-03 | 2 | 0 |
| 4 | .43294582E-08 | 4 | 0 |
| 5 | −.23872190E-08 | 2 | 2 |
| 6 | .65136582E-09 | 0 | 4 |
| 7 | .14001255E-13 | 4 | 2 |
| 8 | .35119581E-13 | 2 | 4 |

where x and y are in millimeters.

7. A front panel for color television tubes, each of the external and internal surfaces of which is of the type defined by a surface with an approximate equation, $$Z=\Sigma C(i)\cdot x^{j(i)}\cdot y^{k(i)}$$

where,

Z is the distance from a plane tangent to the center of the surface contour to points on said surface, x and y represent distances from the center of said panel in Cartesian coordinates, C(i) are a series of coefficients that weight the various $x^{j(i)}\cdot y^{k(i)}$ terms, the coefficients C(i) being convertible into coefficients for other screen diagonal sizes by the equation, $$C(i)=Co(i)\cdot F^{-[j(i)+k(i)-1]},$$

where,

Co(i) are the coefficients in the table below,

F is a scale factor, equal to the diagonal of the screen of a tube, in centimeters, divided by 83 centimeters, j(i) and k(i) are coefficient powers to which the values of x and y, respectively, are raised to in said equation, and where the approximate values for the coefficients Co(i) and coefficient powers j(i) and k(i) are presented as follows for a panel having a screen with a 16 by 9 aspect ratio,

| i | Co(i) | j(i) | k(i) |
|---|---|---|---|
| 1 | −.23773301E-18 | 4 | 4 |
| 2 | .84293632E-04 · p | 4 | 0 |
| 3 | .43121367E-03 | 2 | 0 |
| 4 | .18365999E-08 · p | 4 | 0 |
| 5 | −.17170219E-08 | 2 | 2 |
| 6 | .79434857E-09 | 0 | 4 |
| 7 | .57689504E-14 | 4 | 2 |
| 8 | .2489472E-13 | 2 | 4 |

where x and y are in millimeters and p is a planeity multiplier factor which increases surface curvature of a panel when p is greater than 1 and decreases surface curvature of a panel when p is less than 1.

8. A front panel for color television tubes, each of the external and internal surfaces of which is of the type defined by a surface with an approximate equation, $$Z=\Sigma C(i)\cdot x^{j(i)}\cdot y^{k(i)}$$

where,

Z is the distance from a plane tangent to the center of the surface contour to points on said surface, x and y represent distances from the center of said panel in Cartesian coordinates, C(i) are a series of coefficients that weight the various $x^{j(i)}\cdot y^{k(i)}$ terms, the coefficients C(i) being convertible into coefficients for other screen diagonal sizes by the equation, $$C(i)=Co(i)\cdot F^{-[j(i)+k(i)-1]},$$

where,

Co(i) are the coefficients in the table below,

F is a scale factor, equal to the diagonal of the screen of a tube, in centimeters, divided by 68 centimeters, j(i) and k(i) are coefficient powers to which the values of x and y, respectively, are raised to in said equation, and where the approximate values for the coefficients Co(i) and coefficient powers j(i) and k(i) are presented as follows for a panel having a screen with a 4 by 3 aspect ratio,

| i | Co(i) | j(i) | k(i) |
|---|---|---|---|
| 1 | −.58544384E-18 | 4 | 4 |
| 2 | .11218491E-03 · p | 4 | 0 |
| 3 | .35359521E-03 | 2 | 0 |
| 4 | .43294582E-08 · p | 4 | 0 |
| 5 | −.23872190E-08 | 2 | 2 |
| 6 | .65136582E-09 | 0 | 4 |

-continued

| i | Co(i) | j(i) | k(i) |
|---|---|---|---|
| 7 | .14001255E-13 | 4 | 2 |
| 8 | .35119581E-13 | 2 | 4 |

where x and y are in millimeters and p is a planeity multiplier factor which increases surface curvature of a panel when p is greater than 1 and decreases surface curvature of a panel when p is less than 1.

* * * * *